US006892803B2

(12) United States Patent
Memory et al.

(10) Patent No.: US 6,892,803 B2
(45) Date of Patent: May 17, 2005

(54) HIGH PRESSURE HEAT EXCHANGER

(75) Inventors: Stephen B. Memory, Kenosha, WI (US); Jianmin Yin, Kenosha, WI (US); Gregory G. Hughes, Milwaukee, WI (US)

(73) Assignee: Modine Manufacturing Company, Racine, WI (US)

( * ) Notice: Subject to any disclaimer, the term of this patent is extended or adjusted under 35 U.S.C. 154(b) by 51 days.

(21) Appl. No.: 10/299,283

(22) Filed: Nov. 19, 2002

(65) Prior Publication Data

US 2004/0094291 A1 May 20, 2004

(51) Int. Cl.[7] ..... F28D 7/08
(52) U.S. Cl. ..... 165/165; 165/150
(58) Field of Search ..... 165/140, 150, 165/164, 165

(56) References Cited

U.S. PATENT DOCUMENTS

| | | | | |
|---|---|---|---|---|
| 1,720,768 A | * | 7/1929 | Spreen | 62/406 |
| 4,587,701 A | | 5/1986 | Koisuka et al. | |
| 4,602,674 A | | 7/1986 | Eriksson | |
| 4,747,450 A | | 5/1988 | Ikegame et al. | |
| 4,942,654 A | | 7/1990 | Wright et al. | |
| 5,036,909 A | | 8/1991 | Whitehead et al. | |
| 5,704,123 A | | 1/1998 | Paulman et al. | |
| 5,875,837 A | * | 3/1999 | Hughes | 165/140 |
| 5,964,284 A | | 10/1999 | Ikejima et al. | |
| 6,212,764 B1 | | 4/2001 | Schornhorst et al. | |
| 6,540,015 B1 | * | 4/2003 | Kawachi et al. | 165/164 |

FOREIGN PATENT DOCUMENTS

| | | |
|---|---|---|
| DE | 19836889 | 2/2000 |
| JP | 2001-174083 | 6/2001 |

* cited by examiner

*Primary Examiner*—Allen J. Flanigan
(74) *Attorney, Agent, or Firm*—Wood, Phillips, Katz, Clark & Mortimer

(57) ABSTRACT

A heat exchanger including inlet and outlet header portions for a refrigerant (such as $CO_2$), serpentine multiport tubes each with a plurality of aligned tube runs, and at least three plate assembly fluid paths. Each plate assembly fluid path includes a pair of spaced plates secured together at their edges to define an enclosed space with a fluid inlet and fluid outlet on opposite sides of the space. One plate of one fluid path is positioned against first aligned tube runs, one plate of a second of the fluid paths is positioned against second aligned tube runs, and a third fluid path is positioned between the first and second aligned tube runs. The plates may be substantially identical to one another.

66 Claims, 6 Drawing Sheets

HIGH PRESSURE HEAT EXCHANGER

BACKGROUND OF THE INVENTION

The present invention is directed toward heat exchangers, and particularly toward high pressure heat exchangers.

As is well known, discharge of refrigerants into the atmosphere is considered to be a major cause of the degradation of the ozone layer. While refrigerants such as HFC's are certainly more environmentally friendly than refrigerants such as CFC's which they replaced, they nonetheless are undesirable in that they may contribute to the so-called greenhouse effect.

Both CFC's and HFC's have been used largely in vehicular applications where weight and bulk are substantial concerns. If a heat exchanger in an automotive air conditioning system is too heavy, fuel economy of the vehicle will suffer. Similarly, if it is too bulky, not only may a weight penalty be involved, but the design of the heat exchanger may inhibit the designer of the vehicle in achieving an aerodynamically "slippery" design that would also improve fuel economy.

Refrigerant leakage to the atmosphere occurs from vehicular air-conditioning systems because the compressor cannot be hermetically sealed as in stationary systems, typically requiring rotary power via a belt or the like from the engine of the vehicle. Consequently, it is desirable to provide a refrigeration system for use in vehicular applications wherein any refrigerant that escapes to the atmosphere would not be as potentially damaging to the environment and wherein system components remain small and lightweight so as to not have adverse consequences on fuel economy.

These concerns have led to consideration of transcritical $CO_2$ systems for use in vehicular applications. For one, the $CO_2$ utilized as a refrigerant in such systems could be claimed from the atmosphere at the outset with the result that if it were to leak from the system in which it was used back to the atmosphere, there would be no net increase in atmospheric $CO_2$ content. Moreover, while $CO_2$ is undesirable from the standpoint of the greenhouse effect, it does not affect the ozone layer and would not cause an increase in the greenhouse effect since there would be no net increase in atmospheric $CO_2$ content as a result of leakage.

However, transcritical systems typically involve very high pressures on the refrigerant side, and therefore heat exchangers used in such systems must be able to withstand such pressures, preferably (particularly in automotive systems) without significantly increasing size and weight.

U.S. Pat. No. 5,875,837 discloses a heat exchanger with serpentine tubes interleaved with flattened plate-like tubes, there being cross flow between the serpentine tube runs and the plate-like tubes. The plate-like tubes define a plurality of discrete flow paths which are open at the tube ends, the tube ends being connected by a header plate and header tank assemblies. It is desirable to facilitate assembly of such heat exchangers. Further, heat exchangers of this design may not be readily adapted for concurrent and countercurrent flow between the separate flow paths of the two tubes.

SUMMARY OF THE INVENTION

In one aspect of the present invention, a heat exchanger is provided, including a refrigerant inlet and outlet header portions, at least one serpentine multiport tube, a fluid heat exchanger inlet and a fluid heat exchanger outlet, and at least three plate assembly fluid paths. The serpentine tube defines a plurality of tube runs with a tube bend between adjacent tube runs, with an inlet end on one tube run for receiving refrigerant from the refrigerant inlet header portion and an outlet end on another tube run for discharging refrigerant into the refrigerant outlet header portion. Each of the plate assembly fluid paths includes a pair of spaced plates secured together at their edges to define an enclosed space with a fluid inlet to the one side of the space and a fluid outlet from the other side of the space. The fluid inlet of a first of the plate assembly fluid paths receives fluid from the fluid heat exchanger inlet, and one plate of the first of the plate assembly fluid paths is positioned against the one tube run of the first tube. The fluid outlet of a second of the plate assembly fluid paths discharges fluid to the fluid heat exchanger outlet, and one plate of the second of the plate assembly fluid paths is positioned against the other tube run of the first tube. A third of the plate assembly fluid paths is positioned between the tube runs of the first tube.

In one form of this aspect of the present invention, a second serpentine multiport tube is generally aligned with and behind the first tube, with the one plate of the first of the plate assembly fluid paths positioned against the inlet tube run of the second tube, the one plate of the second of the plate assembly fluid paths positioned against the outlet tube run of the second tube, and the third of the plate assembly fluid paths positioned between the tube runs of the second tube.

In alternate forms of this aspect of the present invention, the fluid paths may flow transverse to the tube runs, in substantially the same direction as the refrigerant flow in adjacent tube runs, or in substantially the opposite direction.

In still other forms, turbulating elements may be provided in the enclosed space between the fluid inlet and the fluid outlet. Also, the refrigerant may be $CO_2$.

In another form, the heat exchanger may be used in a transcritical cooling system.

In another aspect of the present invention, a heat exchanger is provided including a first and second fluid paths for first and second fluids. The first path includes a multiport serpentine tube defining a plurality of tube runs with tube bends on the order of 180 degrees between adjacent spaced tube runs. The second fluid path includes a plurality of plate heat exchanger sets, each plate heat exchanger set including two plate heat exchangers each defined by a pair of spaced plates secured together at their edges to define an enclosed space. The first and second fluid paths are interleaved with each tube run including the plate heat exchangers of one of the plate heat exchanger sets disposed against opposite sides of the tube run.

In one form of this aspect of the invention, one of the tube runs has an inlet for receiving the first fluid from an inlet header portion and another of the tube runs has an outlet for discharging the first fluid to an outlet header portion, and one of the plate heat exchanger sets has an inlet for receiving the second fluid from a fluid heat exchanger inlet and another of the plate heat exchanger sets has an outlet for discharging the second fluid to a fluid heat exchanger outlet. With this form, the one of the plate heat exchanger sets may have an outlet for discharging the second fluid to an inlet of the other of the plate heat exchanger sets. Additionally, the one plate heat exchanger set may be disposed against a side of the other tube run and the other of the plate heat exchanger sets may be disposed against a side of said one tube run.

In still other forms, turbulating elements may be provided in the enclosed space between the fluid inlet and the fluid outlet, the plate heat exchangers may be drawn cup heat exchangers, and/or the first fluid may be refrigerant, including $CO_2$.

In alternate forms of this aspect of the present invention, the plate heat exchangers may have inlets and outlets disposed so that the second fluid flows through the plate heat exchangers transverse to the tube runs, in substantially the same direction as the first fluid flows in adjacent tube runs, or in substantially the opposite direction.

In another form of this aspect of the invention, the heat exchanger may be used in a transcritical cooling system.

In still another aspect of the present invention, a heat exchanger is provided, including refrigerant inlet and outlet header portions, first and second serpentine multiport tubes, a fluid heat exchanger inlet, a fluid heat exchanger outlet, and first, second, third and fourth plate heat exchangers. Each multiport tube defines a plurality of tube runs with a tube bend between adjacent tube runs with the tube runs of the second tube being substantially aligned with the tube runs of the first tube. Each tube also has an inlet end on one tube run for receiving refrigerant from the refrigerant inlet header portion and an outlet end on another tube run for discharging refrigerant into the refrigerant outlet header portion. Each plate heat exchanger includes a pair of spaced plates secured together at their edges to define an enclosed space with a fluid inlet to one side of the space and a fluid outlet from the other side of the space. The fluid inlet of the first and second plate heat exchangers receives fluid from the fluid heat exchanger inlet, and the fluid outlet of the third and fourth plate heat exchangers discharges fluid to the fluid heat exchanger outlet. One plate of the first plate heat exchanger is positioned against one side of the one tube run of the first and second tubes and one plate of the second plate heat exchanger is positioned against the other side of the one tube run of the first and second tubes. One plate of the third plate heat exchanger is positioned against one side of the other tube run of the first and second tubes and one plate of the fourth plate heat exchanger is positioned against the other side of the other tube run of the first and second tubes.

In one form of this aspect of the present invention, a fluid outlet for the first and second plate heat exchangers is generally disposed at the opposite end of the one tube run from the first and second plate heat exchanger fluid inlet, and a fluid inlet to the third and fourth plate heat exchangers is generally disposed at the opposite end of the other tube run from the third and fourth plate heat exchanger fluid outlet. In this form, the fluid flow in the plate heat exchangers may be in substantially the same direction, or in substantially the opposite direction, as the refrigerant flows in the tube run between the plate heat exchangers. Alternately, the tube runs of both tubes may be between the fluid inlets and outlets of the associated plate heat exchangers, whereby the fluid in the plate heat exchangers flows in a direction substantially transverse to the direction of flow of the refrigerant in the tube runs.

Previously described forms of the other aspects of the invention may also be used with this aspect of the present invention including, for example, drawn cup plate heat exchangers, turbulating elements in the plate heat exchanger enclosed spaces, $CO_2$ refrigerant, and use in a transcritical cooling system.

In yet another aspect of the present invention, a heat exchanger, is provided including a refrigerant path including a multiport serpentine tube defining a plurality of tube runs with tube bends therebetween, and a fluid path including a plurality of plate heat exchangers. Each plate heat exchanger includes a pair of plate members each having a rim therearound, the rims being securable together to enclose a space between the plate members, with an inlet through at least one of the plate members and an outlet through at least one of the plate members. The plate members are substantially identical except that selected ones of the plate members have both an inlet and an outlet, and the plate members are stacked to define a selected fluid path with tube runs of the serpentine tube interleaved between the plate heat exchangers with at least one plate member of a plate heat exchanger disposed against each side of the tube runs.

In one form of this aspect of the invention, the inlets and outlets of the plate members are selectively aligned to provide a selective fluid path.

In another form of this aspect of the invention, a flange is provided at each inlet and outlet, with the flange being raised from the associated plate member substantially half the thickness of the tube.

DETAILED DESCRIPTION OF THE INVENTION

Figure 1:
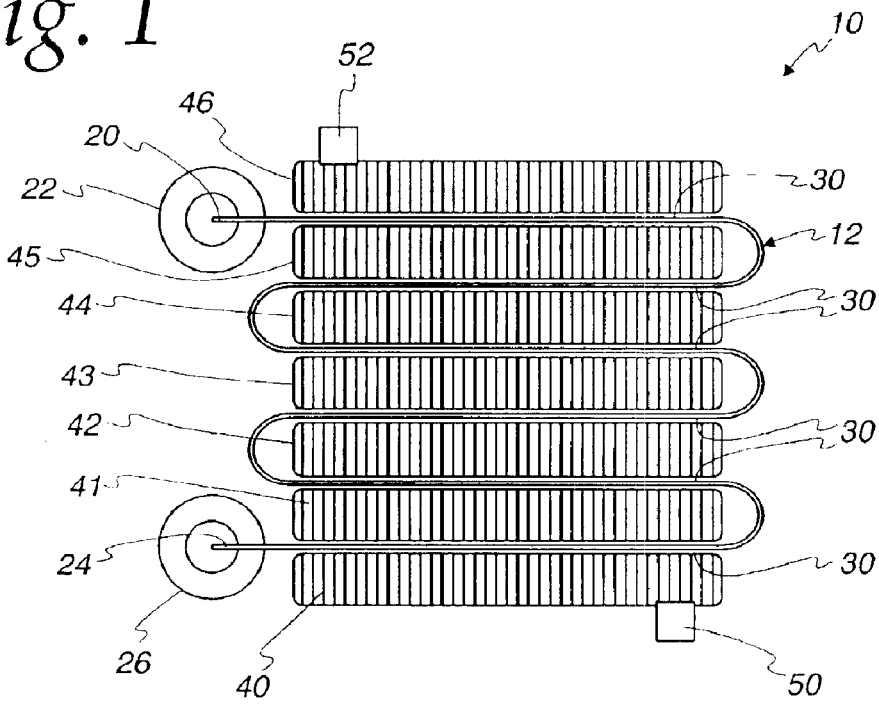
FIG. 1 is an end schematic view of a cross flow heat exchanger embodying the present invention.
Figure 2:
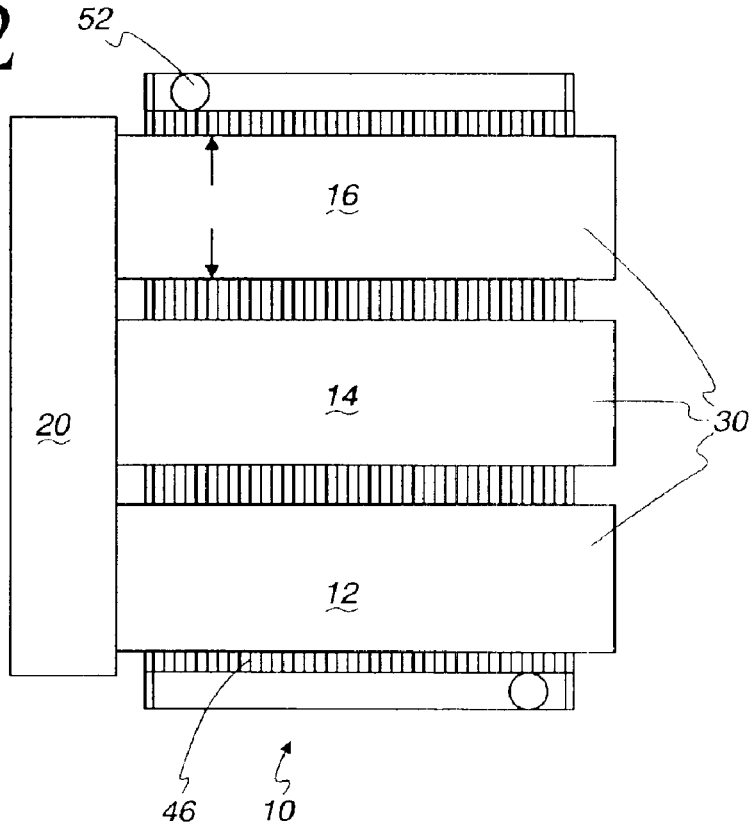
FIG. 2 is a top view of the FIG. 1 embodiment with the top plate heat exchanger removed.

FIGS. 1–2 schematically illustrate one embodiment of a heat exchanger 10 incorporating the present invention. With the illustrated heat exchanger 10, three suitable serpentine multiport tubes 12, 14, 16 are included, each of which has an inlet end 20 for receiving high pressure refrigerant from a source (e.g., inlet header tube 22) and an outlet end 24 for discharging high pressure refrigerant to a receiver (e.g., outlet header tube 26).

Multiport tubes 12, 14, 16 are now well known in the art, and include web members extending between the sides of the tubes 12, 14, 16 to provide strength against internal pressure and to further assist in heat transfer of the refrigerant to the tube walls. Such tubes 12, 14, 16 may be microchannel tubes, the hydraulic diameter of which can be varied according to design requirements. It should also be appreciated that, depending on required heat exchange capacity, more or less than three such tubes could be used within the scope of the present invention, with greater numbers of tubes (and ports) resulting in less pressure drop therein but also potentially undesirably increasing the size, weight and cost of the heat exchanger as well.

The serpentine tubes 12, 14, 16 each include five 180 degree bends between six separate spaced and parallel tube runs 30, with the tube runs 30 of the three tubes 12, 14, 16 being generally aligned with one another. It should be appreciated, however, that the serpentine tubes 30 could have more or less than the illustrated six tube runs 30.

Interleaved or layered between the tube runs 30 are a plurality of plate-type heat exchangers 40, 41, 42, 43, 44, 45, 46, seven such heat exchangers 40–46 being shown in the FIGS. 1–2 embodiment. As further described hereafter, the plate heat exchangers 40–46 are each formed of a pair of plates secured around their edges to form an enclosed space therebetween, with each plate heat exchanger 40–46 having both an inlet and an outlet for a fluid (e.g., water or engine coolant) carried therein, where heat exchange between the refrigerant and the fluid is desired. In a preferred form, suitable turbulating elements (discussed further below) may be provided in the enclosed space to enhance flow characteristics of the fluid therethrough, and also to add strength to the plate heat exchanger. Such turbulating elements can consist of a separate turbulator (e.g., an offset strip fin), or may be an integral part of the plates of the heat exchanger, such as ribs stamped into the plates. Where the plate heat exchanger is manufactured using brazing, for example, the turbulating element may provide strength by securing the opposite plates together at points other than their edges.

The plates of the plate heat exchanger 40–46 are suitably disposed against walls on opposite sides of the adjacent tube runs 30 of the serpentine tubes 12, 14,16 whereby an effective heat transfer contact therebetween exists.

A heat exchanger fluid inlet 50 is provided at one corner of the bottom-most of the illustrated plate heat exchangers 40, and a heat exchanger fluid outlet 52 is provided at one corner of the top-most of the illustrated plate heat exchanger 46. Though not shown in FIGS. 1–2, it will be appreciated that:

a. outlets from plate heat exchangers 41, 43, 45 may be secured to inlets for plate heat exchangers 42, 44, 46 respectively, in line with the heat exchanger fluid inlet 50, and
b. outlets from plate heat exchangers 40, 42, 44 may be secured to inlets for plate heat exchangers 41, 43, 45, respectively, in line with the heat exchanger fluid outlet 52.

With such a configuration, it will be appreciated that flow of the fluid will occur across the three serpentine tubes 12, 14, 16 in each plate heat exchanger 40–46 (i.e., either generally from the bottom right to upper left or from the upper left to the bottom right of FIG. 2). Further, flow between the heat exchanger fluid inlet 50 and heat exchanger fluid outlet 52 will be in a generally serpentine manner from bottom to top in FIG. 1 (i.e., in addition to the cross flow between top and bottom in FIG. 2, flow will also be [as shown in FIG. 1] from right to left in plate heat exchanger 40, then up to plate heat exchanger 41, then left to right in plate heat exchanger 41, then up to plate heat exchanger 42, etc. until flowing from right to left in plate heat exchanger 46 to heat exchanger fluid outlet 52).

As illustrated, the heat exchanger 10 also uses counterflow, with the heat exchanger fluid inlet 50 being with plate heat exchanger 40 adjacent the tube run 30 having the outlet end 24 and the heat exchanger fluid outlet 52 being with the plate heat exchanger 46 adjacent the tube run 30 having the inlet end 20. However, it should be appreciated that the inlets and outlets could be switched where convenient for an application, with the heat exchanger fluid inlet being with a plate heat exchanger adjacent the tube run with the inlet end, and the heat exchanger fluid outlet being with a plate heat exchanger adjacent the tube run with the outlet end.

Figure 3:
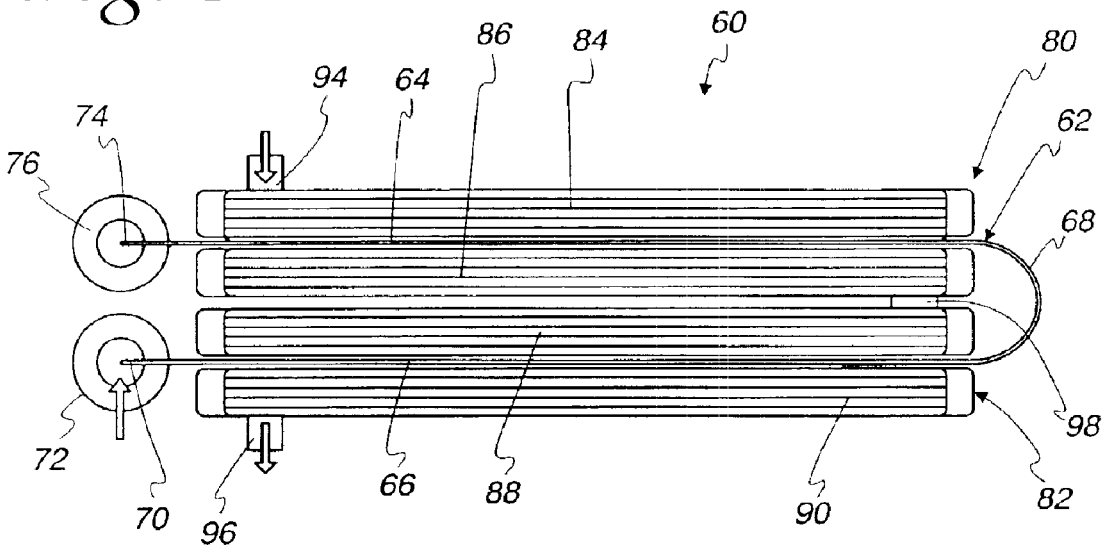
FIG. 3 is an end schematic view of a counterflow heat exchanger embodying the present invention.
Figure 4:
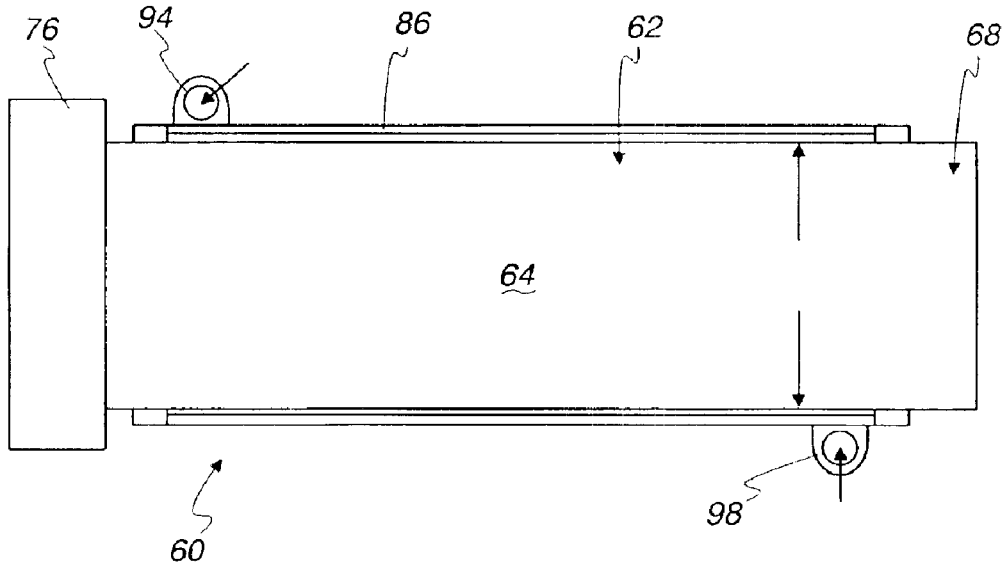
FIG. 4 is a top view of the FIG. 3 embodiment with the top plate heat exchanger removed.

FIGS. 3–4 schematically illustrate another embodiment of a heat exchanger 60 incorporating the present invention. With the illustrated heat exchanger 60, a single suitable serpentine multiport tube 62 is included having two parallel tube runs 64, 66 connected by a 180 degree bend. One tube run 66 has an inlet end 70 for receiving high pressure refrigerant from a source (e.g., inlet header tube 72) and the other tube run has an outlet end 74 for discharging high pressure refrigerant to a receiver (e.g., outlet header tube 76).

As noted with the first described embodiment, it should be appreciated that more than the one tube 62 could be used within the scope of the present invention, depending upon the requirements of the intended application. It should also be appreciated that the serpentine tube 62 could have more than the illustrated two tube runs 64, 66.

Two sets of plate heat exchangers 80, 82 are provided, one for each of the tube runs 64, 66 respectively. Each plate heat exchanger set 80, 82 includes two plate heat exchangers, 84, 86 and 88, 90 respectively, disposed against opposite sides of the associated tube run 64, 66. Preferably, a gap is provided between facing plate surfaces of the inner two plate heat exchangers 86, 88.

As illustrated in FIG. 3, a heat exchanger fluid inlet 94 is provided at one corner of the top set of plate heat exchangers 80 and a heat exchanger fluid outlet 96 is provided at one corner of the other set of plate heat exchangers 82. The inlet 94 and outlet 96 may be aligned as illustrated in FIG. 4, with the inlet 94 and outlet 96 both being in the same header, but suitably separated by a baffle in the header such as is understood in the art. A turnaround header 98 is provided at the opposite end from the inlet 94 and outlet 96, such turnaround header 98 being suitably connected to the plate heat exchangers 84, 86, 88, 90 of the two sets of plate heat exchangers 80, 82 so that fluid flows from one set 80 to the other set 82.

It should thus now be appreciated that a counterflow of fluid will occur in the plate heat exchangers, whereby (in the orientation as illustrated in FIG. 3):

1. fluid will flow from left to right in the plate heat exchangers 84, 86 disposed against opposite sides of tube run 64 (in which refrigerant is flowing from right to left);
2. fluid will flow out of plate heat exchangers 84, 86 and then down turnaround header 98 into plate heat exchangers 88, 90; and
3. fluid will flow from right to left in the plate heat exchangers 88, 90 disposed against opposite sides of tube run 66 (in which refrigerant is flowing from left to right).

However, as noted with the previously described embodiment, it should also be appreciated that it would be within the scope of the present invention to alternatively provide the heat exchanger fluid inlet with the set of plate heat exchangers adjacent the tube run with the inlet end, with the heat exchanger fluid outlet being with the set of plate heat exchangers adjacent the tube run with the outlet end.

Figure 5:
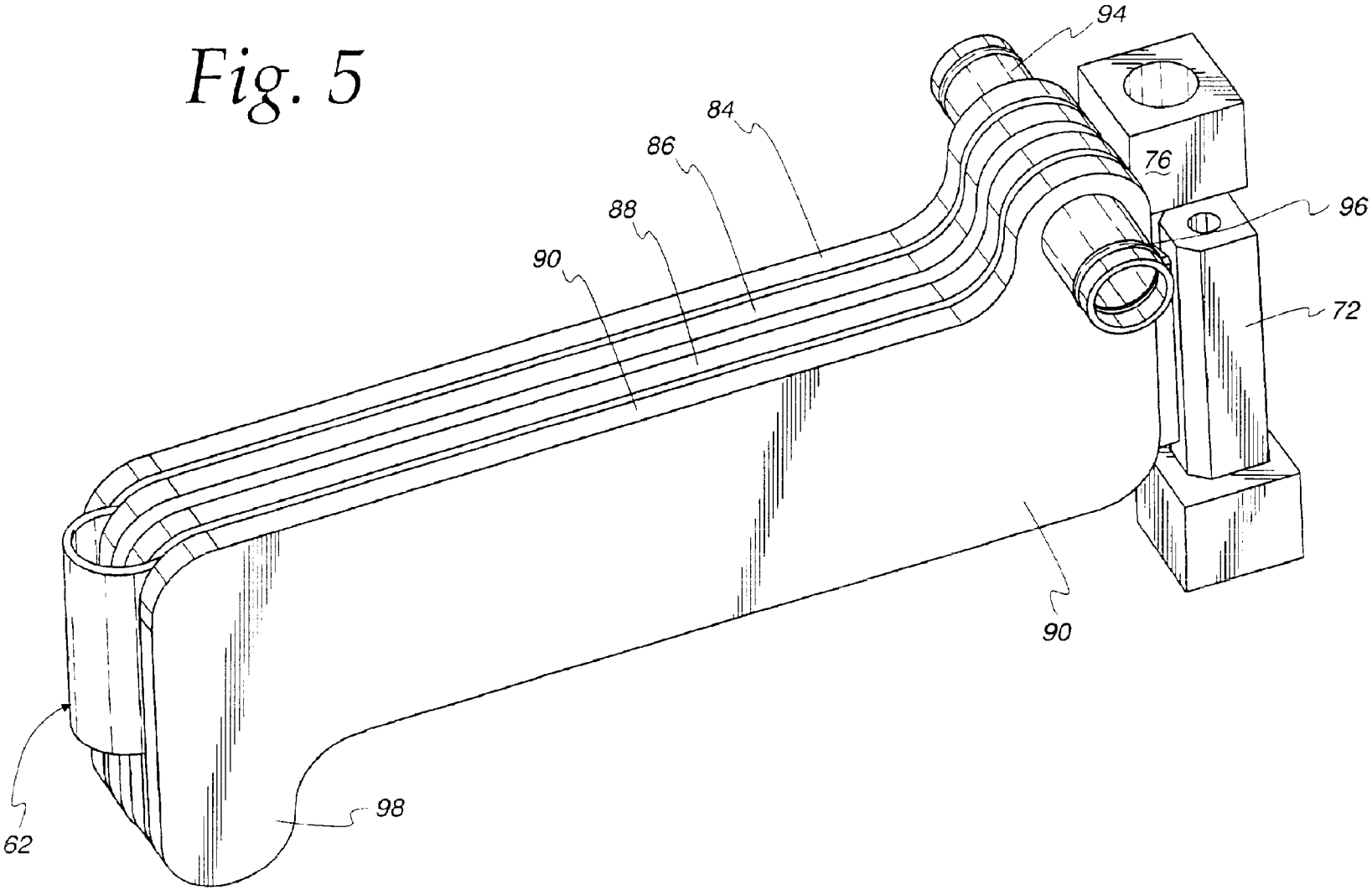
FIG. 5 is a perspective view of a counterflow heat exchanger according to FIGS. 3–4.

FIG. 5 illustrates a counterflow heat exchanger according to the schematic illustration of FIGS. 3–4.

Figure 6:
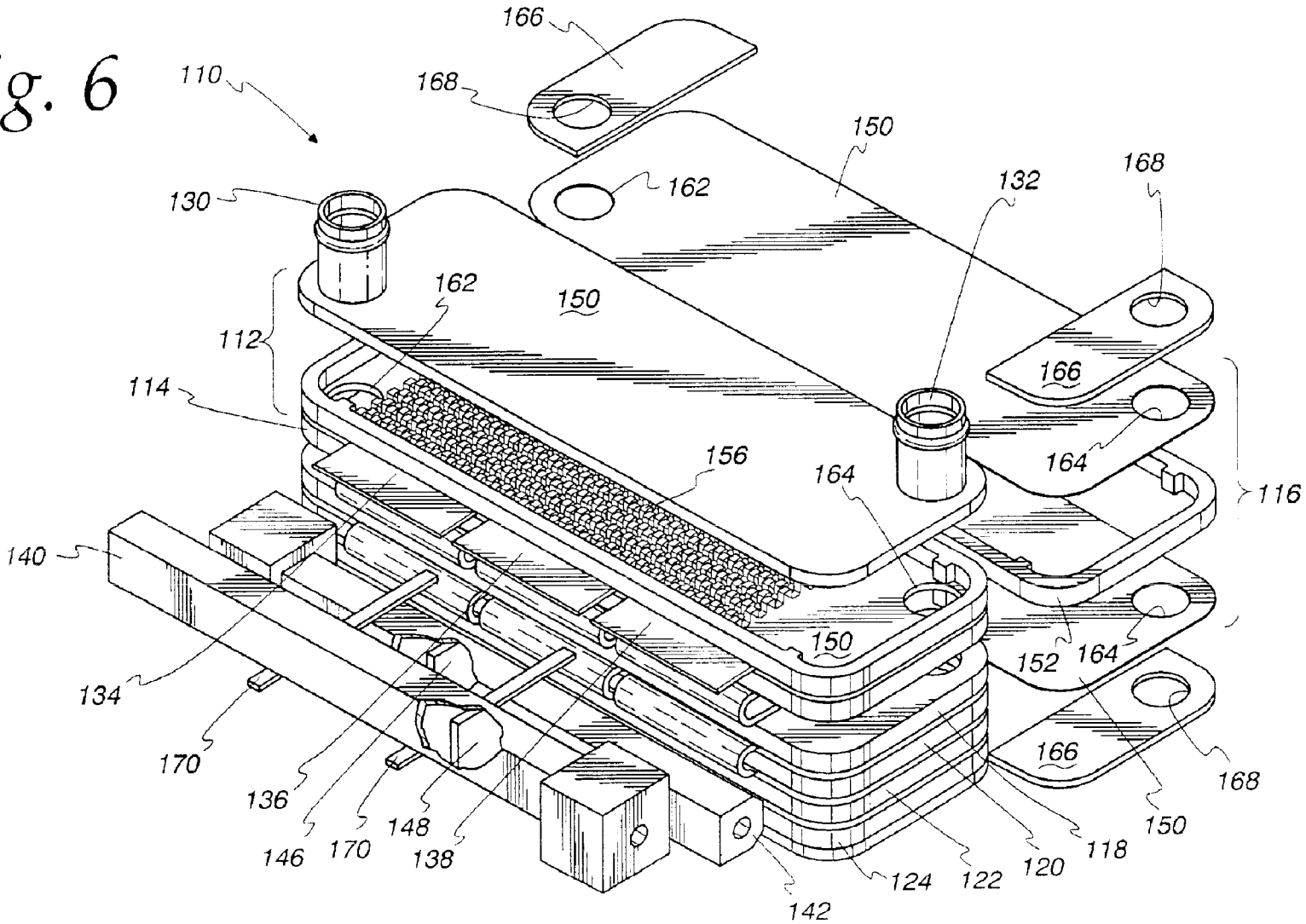
FIG. 6 is a perspective exploded and partially broken away view of a cross flow heat exchanger.
Figure 7:
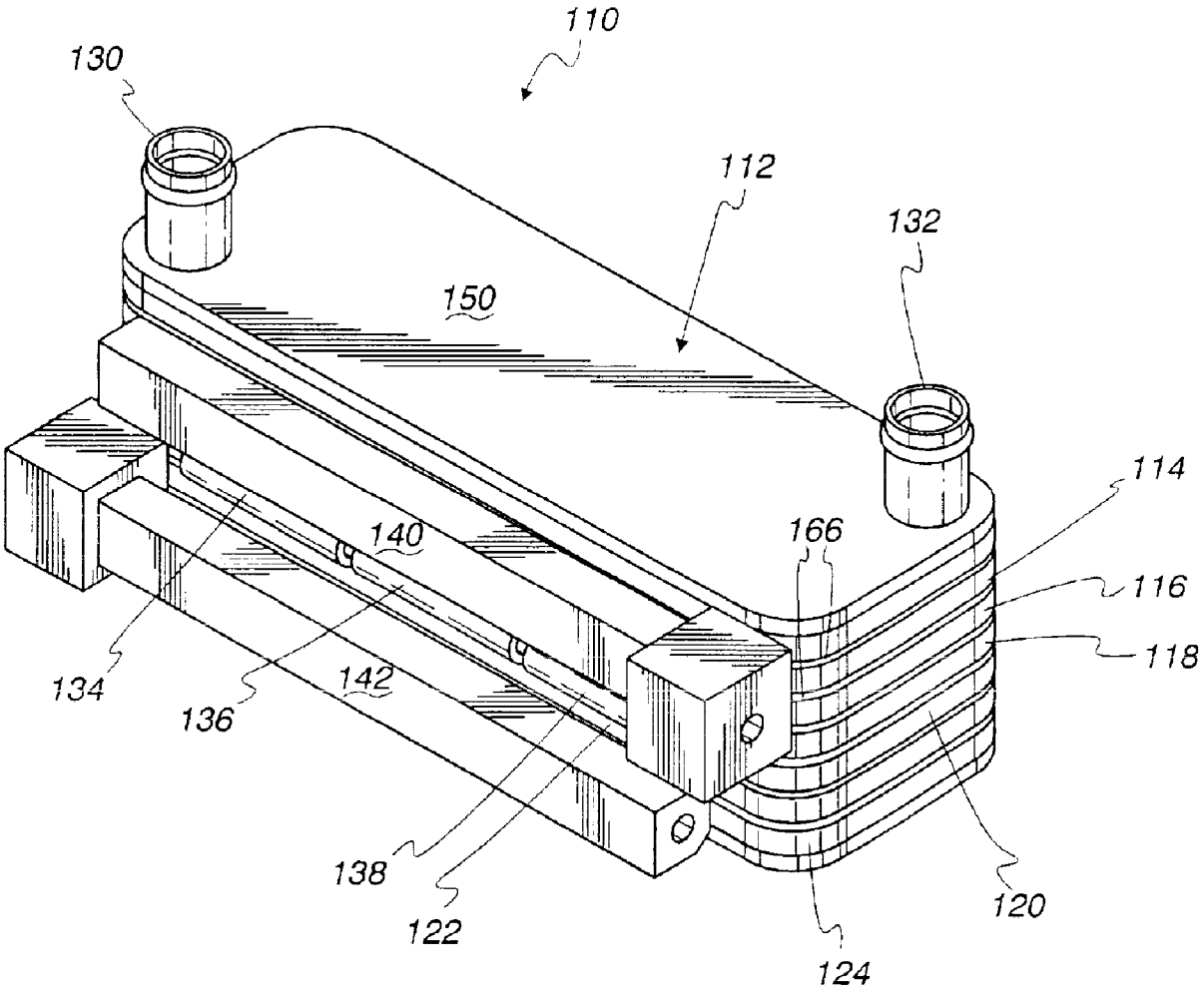
FIG. 7 is a perspective view of the heat exchanger of FIG. 6.

FIGS. 6–7 illustrate yet another embodiment of a heat exchanger 110 embodying the present invention similar to the FIGS. 1–2 embodiment except that all of the plate heat exchangers 112, 114, 116, 118, 120, 122, 124 flow together in the same direction, with each having aligned inlets and outlets at opposite corners connected to the fluid heat exchanger inlet 130 and fluid heat exchanger outlet 132, respectively.

Specifically, the heat exchanger 110 includes three serpentine tubes 134, 136, 138 extending between outlet and inlet headers 140, 142 (generally, though specific inlets and outlets are indicated in the descriptions herein, it should be understood that which port is the inlet and which is the outlet could be switched depending upon the application). Like the embodiment illustrated in FIG. 1, the tubes 134–138 have six tube runs interleaved between the seven plate heat exchangers 112–124.

Baffles 146, 148 (partially seen in the broken away view of the headers 140, 142 in FIG. 6) may be provided in the outlet and inlet headers 140, 142 to provide sequential flow through the tubes 134–138. Specifically, fluid entering inlet header 142 (at the bottom left in FIGS. 6–7) will be blocked by the baffle 146 therein so that it is all directed to the first serpentine tube 134. Fluid exits from the first serpentine tube 134 into the outlet header 140, and then into the second serpentine tube 136 (baffle 148 blocking flow to the third serpentine tube 138). The fluid then exits from the second serpentine tube 136 into the inlet header 142 and then into the third serpentine tube 138. Finally, fluid exits from the third serpentine tube 138 into the outlet header 140 (at the upper front right in FIGS. 6–7), from which it is outlet from the heat exchanger 110.

Where such sequential flow through the tubes 134–138 is not desired, the baffles 146, 148 may be eliminated.

In the disclosed embodiment, the plate tube heat exchangers 112–124 are each formed from two spaced plates 150 suitably secured to an enclosing side wall 152. A turbulator 156 is secured between the spaced plates 150. Inlet and outlet openings 162, 164 are provided at opposite corners of the plates 150. (It should be understood that though the disclosed embodiment has such openings at opposite corners, it would be within the scope of the invention in any of the disclosed embodiments if the inlets and outlets were located elsewhere including, for example, the middle of the plate heat exchanger end.

Spacer inserts 166 are provided between the plate heat exchangers 112–124 at the ends, which inserts 166 have openings 168 therethrough in alignment with the plate openings 162, 164. The inserts 166 preferably have a thickness substantially equal to the thickness of the serpentine tubes 134–138, allowing the inserts 166 to be sealed securely to the plate heat exchangers abutting opposite sides thereof (providing a leak-free fluid path between the openings of adjacent plate heat exchangers 112–124), while also allowing plate heat exchangers 112–124 to abut securely against the tubes 134–138 for desired heat transfer therebetween. Additional intermediate inserts 170 also having a thickness substantially equal to the thickness of the serpentine tubes 134–138 may also be provided for support between the tubes 134–138.

It should thus be particularly appreciated from the FIGS. 6–7 embodiment that heat exchangers made according to the present invention can be advantageously made in a modular fashion. Each plate heat exchanger 112–124 is identical to the others, and all the plates 150 of the plate heat exchangers 112–124 are identical to the other plates 150. The inserts 166 are also the same. Thus, a tube can be bent to any desired size (i.e., with a selected number of tube runs), and the necessary number of identical plate heat exchangers 112–124 can be used as needed based on the selected number of tube runs (e.g., in a cross flow structure such as in FIGS. 6–7, the number of plate heat exchangers is one more than the number of tube runs).

It should also be appreciated that counterflow could also be readily provided in a similarly modular fashion. For example, each plate could be provided with only one opening therethrough, with the plates alternately turned to provide inlets and outlets at opposite corners. Alternatively, plates with two openings such as shown in FIG. 6 could be used, with some inserts provided without openings therethrough, such inserts being used to close an opening in one of the plates 150 where fluid flow therethrough is not desired.

Figure 8:
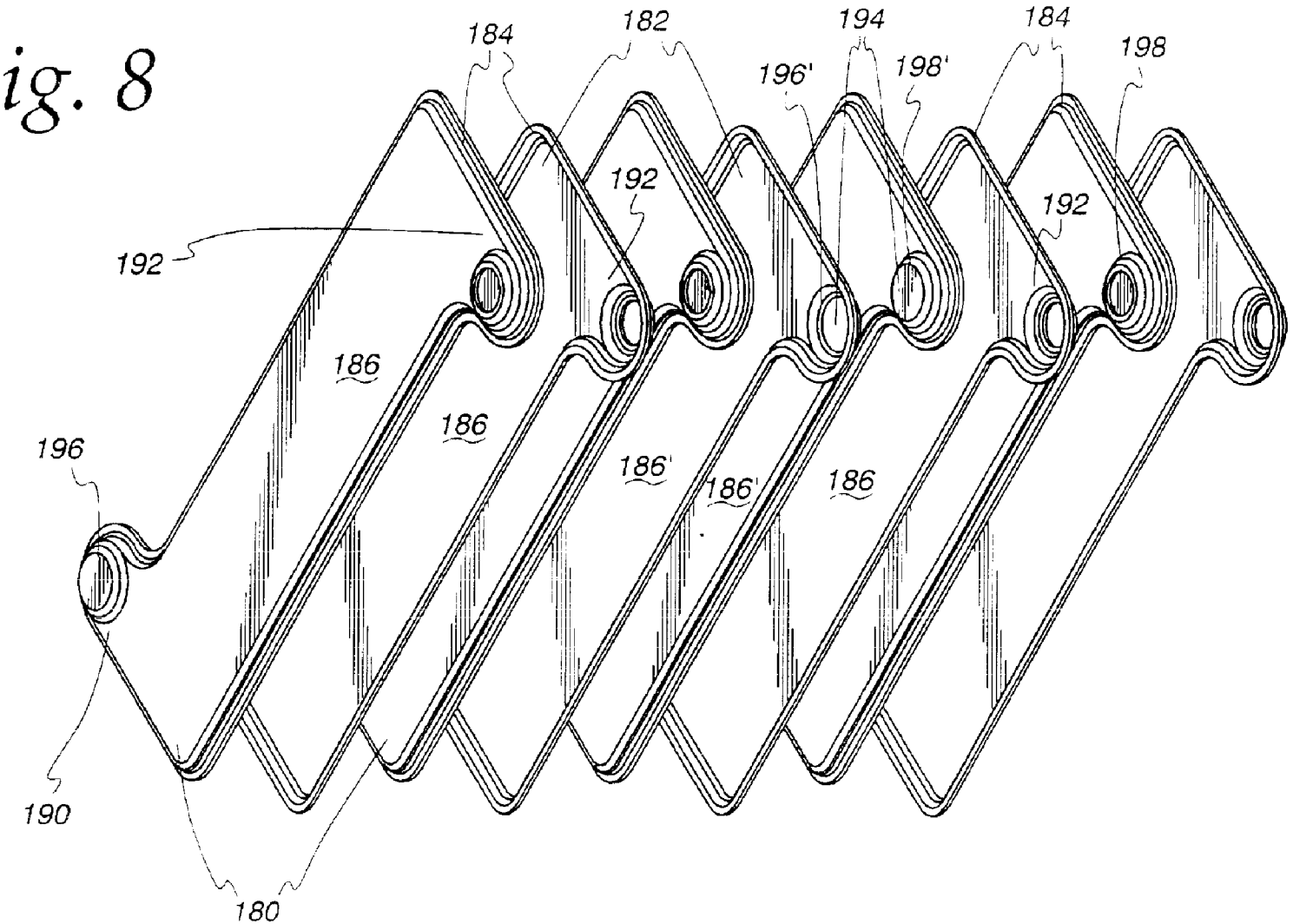
FIG. 8 is an exploded view of exemplary drawn cup type plates usable with heat exchangers embodying the present invention.

FIG. 8 illustrates yet another configuration of plates 180, 182 which may be used in manufacturing plate heat exchangers usable in the present invention, with a rim 184 integrally formed around a plate member 186 where the rims 184 are suitably secured together along their length to define the enclosed space inside the plate heat exchanger.

Lateral flanges 190, 192 may be provided on the plates 180, 182, each flange 190, 192 having an opening 194 therethrough and a boss 196, 198 extending in the opposite direction from the plate member 186 from the rims 184. The plates 180, 182 may be stacked such as illustrated, with facing bosses 196, 198 connected together to define a fluid path between plate heat exchangers (and the bosses 196, 198 preferably being raised a combined amount equal to the thickness of the serpentine tubes being used therewith to provide proper spacing in which the plate members 186 are disposed against the wall of the adjacent tubes).

If formed in a stamping operation, it will be appreciated that the blanks used in such an operation may be identical for the different plates 180, 182, with the direction of stamping merely being different for forming the two different plates 180, 182.

As with the other described embodiments, it should be appreciated that plates embodying the concept of those disclosed in FIG. 8 could be readily modified for other configurations. For example, the plates 180, 182 shown in FIG. 8 all have openings 194 through both flanges 190, 192. With such a structure, there will be purely cross flow, with aligned fluid inputs at one end and aligned fluid outputs at the other end, so that fluid will flow parallel (i.e., not in a serpentine back and forth manner) in all of the plate heat exchangers in substantially the same manner as fluid flow in the FIGS. 6–7 embodiment. Alternatively, some of the bosses 196, 198 could be provided without an opening so as to not allow fluid flow therethrough to the adjacent plate heat exchanger, in which case selected serpentine type fluid flow could be provided. This could be accomplished by blocking selected openings 194 to provide the desired flow, for example, by adding a blocking member over the opening, or where the openings are formed in a stamping operation by not stamping openings in selected ones of the plates 180, 182. Still other variations could also be readily used within the scope of the invention while still retaining the substantial advantages of modular manufacture such as previously disclosed.

Of course, it should also be appreciated that plates of the type such as illustrated in FIG. 8 could also be readily adapted for use with a counter flow type structure such as shown in FIG. 5. Specifically, four of the plates 180, 182 on the left in FIG. 8 could be used to make two plate heat exchangers on opposite sides of one tube run, and the other four plates 180, 182 (on the right in FIG. 8) could be used to make two plate heat exchangers on opposite sides of the second tube run. The bosses (identified in FIG. 8 as 196' and 198') which would otherwise be secured together between the two middle plate members would merely be suitably blocked to prevent flow therebetween to provide a flow such as occurs in the FIG. 5 embodiment (the bosses to be blocked are hidden in FIG. 8). The bosses at both ends of the middle plate members (identified in FIG. 8 as 186') may be adjusted in height and/or one or more suitable spacers may be provided if the middle gap between their plate heat exchangers is desired to be different than other gaps provided between the plate heat exchangers for the tube runs.

It should be appreciated that heat exchangers according to the present invention are particularly suitable for modular type manufacturing allowing easy and relatively inexpensive manufacturing of such heat exchangers for different applications, where different numbers of tubes and/or tube runs may be required. Further, such compact and lightweight designs can be provided in a single brazing operation with a constant pressure placed over the entire heat exchanger during such operation.

Further, the fluid used in such heat exchangers may be readily contained without the necessity of a surrounding shell, with such fluid being advantageously distributed for good heat transfer due, for example, to the short header lengths possible with such heat exchangers. Refrigerant will also be advantageously distributed in the structure, which structure will also be able to handle high refrigerant pressures (e.g., in transcritical $CO_2$ systems, typical burst pressures might be up to 4000 psi if used as a heat source and up to 6000 psi if used as a heat sink).

Still further, where turbulators are used, their height may be easily varied to give the fluid-side surface area required for the particular application in which the heat exchanger is to be used.

It should also be appreciated that while the above description has generally been made in the context of transcritical refrigeration systems, the present invention could also be advantageously used in a wide variety of heat exchange applications.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A heat exchanger, comprising:

refrigerant inlet and outlet header portions;

at least a first serpentine multiport tube defining a plurality of tube runs with a tube bend between adjacent tube runs, said first tube having:

an inlet end on one tube run for receiving refrigerant from said refrigerant inlet header portion, and an outlet end on another tube run for discharging refrigerant into said refrigerant outlet header portion;

a second serpentine multiport tube defining a second plurality of tube runs with a tube bend between adjacent tube runs, said second tube being generally aligned with and behind said first tube and having:

an inlet end on one tube run for receiving refrigerant from said refrigerant inlet header portion, and an outlet end on another tube run for discharging refrigerant into said refrigerant outlet header portion;

a fluid heat exchanger inlet and a fluid heat exchanger outlet;

at least three plate assembly fluid paths each including a pair of spaced plates secured together at their edges to define an enclosed space with a fluid inlet to said one side of said space and a fluid outlet from said other side of said space, wherein the fluid inlet of a first of said plate assembly fluid paths receives fluid from said fluid heat exchanger inlet, and one plate of said first of said plate assembly fluid paths is positioned against said one tube run of said first tube and is positioned against said one tube run of said second tube, the fluid outlet of a second of said plate assembly fluid paths discharges fluid to said fluid heat exchanger outlet, and one plate of said second of said plate assembly fluid paths is positioned against said another tube run of said first tube and is positioned against said another tube run of said first tube, and a third of said plate assembly fluid paths is positioned between said tube runs of said first tube and is positioned between said tube runs of said second tube.

2. The heat exchanger of claim 1, further comprising:

a first header connected to said inlet end of said first serpentine multiport tube and said outlet end of said second serpentine multiport tube; and a baffle separating said connected inlet end of said first serpentine multiport tube from said connected outlet end of said second serpentine multiport tube.

3. The heat exchanger of claim 1, wherein said plate assembly fluid paths flow transverse to said tube runs.

4. The heat exchanger of claim 1, wherein in each of said plate assembly fluid paths, said fluid flows in substantially the same direction as said refrigerant flows in said tube positioned against said one plate of said fluid path.

5. The heat exchanger of claim 1, wherein in each of said plate assembly fluid paths, said fluid flows in substantially the opposite direction as said refrigerant flows in said tube positioned against said one plate of said fluid path.

6. The heat exchanger of claim 1, further comprising turbulating elements in said enclosed space between said fluid inlet and said fluid outlet.

7. The heat exchanger of claim 1, wherein said refrigerant is $CO_2$.

8. The heat exchanger of claim 1, wherein each of said plate assembly fluid paths includes a fluid inlet and a fluid outlet generally disposed at opposite ends of said tube run.

9. The heat exchanger of claim 1, wherein each of said plate assembly fluid paths includes a fluid inlet and a fluid outlet generally disposed on opposite sides of said tube run.

10. A heat exchanger, comprising:

refrigerant inlet and outlet header portions;

first and second serpentine multiport tubes each defining a plurality of tube runs with a tube bend between adjacent tube runs with said tube runs of said second tube being substantially aligned with said tube runs of said first tube, each tube having an inlet end on one tube run for receiving refrigerant from said refrigerant inlet header portion and an outlet end on another tube run for discharging refrigerant into said refrigerant outlet header portion;

a fluid heat exchanger inlet and a fluid heat exchanger outlet;

first, second, third and fourth plate heat exchangers each including a pair of spaced plates secured together at their edges to define an enclosed space with a fluid inlet to one side of said space and a fluid outlet from the other side of said space, wherein the fluid inlet of said first and second plate heat exchangers receives fluid from said fluid heat exchanger inlet, one plate of said first plate heat exchanger is positioned against one side of said one tube run of said first and second tubes and one plate of said second plate heat exchanger is positioned against the other side of said one tube run of said first and second tubes, the fluid outlet of said third and fourth plate heat exchangers discharges fluid to said fluid heat exchanger outlet, and one plate of said third plate heat exchanger is positioned against one side of said another tube run of said first and second tubes and one plate of said fourth plate heat exchanger is positioned against the other side of said another tube run of said first and second tubes.

11. The heat exchanger of claim 10, wherein said first and second plate heat exchangers have an outlet for discharging fluid to an inlet of said third and fourth plate heat exchangers.

12. The heat exchanger of claim 10, wherein said plate heat exchangers are drawn cup heat exchangers.

13. The heat exchanger of claim 10, further comprising turbulating elements in said enclosed space of said plate heat exchangers.

14. The heat exchanger of claim 10, wherein said refrigerant is $CO_2$.

15. The heat exchanger of claim 10, further comprising:

a fluid outlet for said first and second plate heat exchangers generally disposed at the opposite end of said one tube run from said first and second plate heat exchanger fluid inlet; and a fluid inlet to said third and fourth plate heat exchangers generally disposed at the opposite end of said other tube run from said third and fourth plate heat exchanger fluid outlet.

16. The heat exchanger of claim 15, wherein:

said fluid in said first and second plate heat exchangers flows in substantially the same direction as said refrigerant flows in said one tube run of said first and second tubes; and said fluid in said third and fourth plate heat exchangers flows in substantially the same direction as said refrigerant flows in other tube runs of said first and second tubes.

17. The heat exchanger of claim 15, wherein:

said fluid in said first and second plate heat exchangers flows in substantially the opposite direction as said refrigerant flows in said one tube run of said first and second tubes; and said fluid in said third and fourth plate heat exchangers flows in substantially the opposite direction as said refrigerant flows in other tube runs of said first and second tubes.

18. The heat exchanger of claim 10, further comprising:

a fluid outlet from said first and second plate heat exchangers, said fluid outlet and fluid inlet of said first and second plate heat exchangers being disposed with said one tube runs of said first and second tubes therebetween; and a fluid inlet to said third and fourth plate heat exchangers, said fluid outlet and fluid inlet of said third and fourth plate heat exchangers being disposed with said other tube runs of said first and second tubes therebetween;

whereby said fluid in said plate heat exchangers flows in a direction substantially transverse to the direction of flow of the refrigerant in said tube runs.

19. The heat exchanger of claim 10, further comprising a first header connected to a first end of said first and second serpentine multiport tubes, and a second header connected to a second end of said first and second serpentine multiport tubes, said first header including a baffle separating said connected first end of said first serpentine multiport tube from said connected first end of said second serpentine multiport tube.

20. A transcritical cooling system, including the heat exchanger of claim 10.

21. A heat exchanger, comprising:

a refrigerant path including a multiport serpentine tube defining a plurality of tube runs with tube bends on the order of 180 degrees between adjacent spaced tube runs;

a fluid path including a plurality of plate heat exchangers each comprising a pair of plate members each having a rim therearound, said rims being securable together to enclose a space between said plate members, an inlet through at least one of said plate members, and an outlet through at least one of said plate members;

inlets spaced from said rim in at least some of said plate members; and outlets spaced from said rim in at least some of said plate members;

wherein said plate members are stacked to define a selected fluid path with tube runs of said serpentine tube interleaved between said plate heat exchangers with at least one plate member of a plate heat exchanger disposed against each side of said tube runs.

22. The heat exchanger of claim 21, wherein said inlets and outlets of said plate members are selectively aligned to provide a selective fluid path.

23. The heat exchanger of claim 21, further comprising a flange at each inlet and outlet, said flange being raised from the associated plate member substantially half the thickness of said tube.

24. The heat exchanger of claim 21, wherein said plate members are substantially identical except that selected ones of said plate members have both an inlet and an outlet.

25. The heat exchanger of claim 21, wherein at least one of said pairs of plate members has only one of said inlet in one of said plate members and only one of said outlet in the other of said plate members.

26. The heat exchanger of claim 25, wherein:

a second of said pairs of plate members have only one of said inlet in one of said plate members and only one of said outlet in the other of said plate members; and said one plate member inlet in said second pair of plate members is aligned with and communicates with said other plate outlet in said one pair of said plate members.

27. The heat exchanger of claim 21, wherein said fluid path comprises four plate heat exchangers, wherein two of said plate heat exchangers are on opposite sides of a first of the tube runs, and the other two plate heat exchangers are on opposite sides of a second of the tube runs, whereby fluid flow through said two plate heat exchangers is concurrent with refrigerant flow in said first tube run and fluid flow through said other two plate heat exchangers is concurrent with refrigerant flow in said second tube run.

28. The heat exchanger of claim 21, wherein said pair of plate members define the top and bottom sides of said enclosed space, and each of said plate heat exchangers include said inlet and said outlet in both said top and bottom sides.

29. The heat exchanger of claim 21, wherein:

said inlet of each of said plate heat exchanger is at one end, and said outlet of each of said plate heat exchangers is at the opposite end; and said pairs of plate members are oriented with said one ends aligned and said opposite ends aligned.

30. The heat exchanger of claim 21, wherein:

each of said plate heat exchangers has said inlet at one end and said outlet at the opposite end; and at least one plate heat exchanger has its one end aligned with said opposite end of an adjacent plate heat exchanger.

31. The heat exchanger of claim 21, wherein adjacent plate members of adjacent plate heat exchangers are spaced apart substantially at least the thickness of one of said tube runs, and further comprising flow path extensions disposed between aligned inlets and outlets of adjacent plate members.

32. The heat exchanger of claim 21, wherein said refrigerant in said tube runs flows substantially cross current to said fluid in said plate heat exchangers.

33. The heat exchanger of claim 21, wherein:

said refrigerant in said tube runs and said fluid in said plate heat exchangers are adapted to flow substantially in the same direction, either concurrent or countercurrent; and said plate member inlets and outlets are in plate member portions projecting beyond opposite lateral sides of said tube runs.

34. The heat exchanger of claim 33, further comprising spacer inserts between said plate member portions of adjacent plate heat exchangers, said spacer inserts including openings therethrough connecting aligned inlets and outlets of said adjacent plate heat exchangers.

35. The heat exchanger of claim 21, further comprising a fluid path system inlet and a fluid path system outlet, wherein:

said plurality of plate heat exchangers include said inlets defined by a first set of aligned openings through said spaced plates, said first set of aligned openings being aligned with said fluid heat exchanger inlet for receiving said fluid into said plurality of plate heat exchangers; and said plurality of plate heat exchangers include said outlets defined by a second set of aligned openings through said spaced plates, said second set of aligned openings being aligned with said fluid heat exchanger outlet for outleting said fluid from said plate heat exchangers to said fluid heat exchanger outlet.

36. The heat exchanger of claim 35, wherein said plate members are generally rectangular with said first set of aligned openings in one corner and said second set of aligned openings in the corner opposite said one corner.

37. The heat exchanger of claim 21, further comprising:

a second serpentine multiport tube defining a second plurality of tube runs with a tube bend between adjacent tube runs, said second tube being generally aligned with and behind said first tube and having:

an inlet end on one tube run for receiving refrigerant from a refrigerant inlet header portion, and an outlet end on another tube run for discharging refrigerant into a refrigerant outlet header portion;

wherein said tube runs of said second tube are interleaved with said plate heat exchangers.

38. The heat exchanger of claim 37, further comprising:

a first header connected to said inlet end of said first serpentine multiport tube and said outlet end of said second serpentine multiport tube; and a baffle separating said connected inlet end of said first serpentine multiport tube from said connected outlet end of said second serpentine multiport tube.

39. The heat exchanger of claim 21, wherein in each of said plate heat exchangers, said fluid flows in substantially the same direction as said refrigerant flows in one tube run positioned adjacent said plate heat exchanger.

40. The heat exchanger of claim 21, wherein in each of said plate heat exchangers, said fluid flows in substantially the opposite direction as said refrigerant flows in one tube run positioned adjacent said plate heat exchanger.

41. The heat exchanger of claim 21, further comprising turbulating elements in said enclosed space of said plate heat exchangers.

42. The heat exchanger of claim 21, wherein said refrigerant is $CO_2$.

43. A transcritical cooling system, including the heat exchanger of claim 21.

44. The heat exchanger of claim 21, wherein said plate heat exchangers are drawn cup heat exchangers.

45. A heat exchanger, comprising:

refrigerant inlet and outlet header portions;

at least a first serpentine multiport tube defining a plurality of tube runs with a tube bend between adjacent tube runs, said first tube having:

an inlet end on one tube run for receiving refrigerant from said refrigerant inlet header portion, and an outlet end on another tube run for discharging refrigerant into said refrigerant outlet header portion;

a fluid heat exchanger inlet and a fluid heat exchanger outlet; and at least three plate assembly fluid paths, each plate assembly fluid path including a pair of spaced plates secured together about their periphery to define an enclosed space with a portion of said plates being interleaved with said tube runs, and inlet and outlet portions of said plates projecting beyond said interleaved portions, said inlet and outlet plate portions including connected aligned openings defining fluid paths between said plate assembly fluid paths.

46. The heat exchanger of claim 45, wherein at least one of said pairs of spaced plates has only one of said openings in one of said plates and only one of said openings in the other of said plates.

47. The heat exchanger of claim 46, wherein:

a second of said pairs of spaced plates have only one of said openings in one of said plates and only one of said openings in the other of said plates;

said one plate one opening in said one pair of said spaced plates is an inlet and said other plate one opening in said one pair of said spaced plates is an outlet; and said one plate one opening in said second pair of said spaced plates is an inlet aligned with and communicating with one of said plate openings in said one pair of said spaced plates.

48. The heat exchanger of claim 45, further comprising a fourth plate assembly fluid path, wherein two of said plate assembly fluid paths are on opposite sides of a first of the tube runs, the other two of said plate assembly fluid paths are on opposite sides of a second of the tube runs, whereby fluid flow through said two plate assembly fluid paths is concurrent with refrigerant flow in said first tube run and fluid flow through said other two plate assembly fluid paths is concurrent with refrigerant flow in said second tube run.

49. The heat exchanger of claim 45, wherein said pairs of spaced plates each have aligned openings in both of said plates in both said inlet and outlet portions.

50. The heat exchanger of claim 45, wherein said pair of spaced plates define the top and bottom sides of said enclosed space, and each of said openings is in one of said top and bottom sides.

51. The heat exchanger of claim 45, wherein:

said inlet portion of each of said plate assembly fluid paths is at one end, and said outlet portion of each of said plate assembly fluid paths is at the opposite end; and said plate assembly fluid paths are oriented with said one ends aligned and said opposite ends aligned.

52. The heat exchanger of claim 45, wherein:

said inlet portion of each of said plate assembly fluid paths is at one end, and said outlet portion of each of said plate assembly fluid paths is at the opposite end; and at least one plate assembly fluid path has its one end aligned with said opposite end of an adjacent plate assembly fluid path.

53. The heat exchanger of claim of 45, wherein adjacent plate assembly fluid paths are spaced apart substantially at least the thickness of one of said tube runs, and further comprising flow path extensions disposed between aligned ones of said openings.

54. The heat exchanger of claim 45, wherein said refrigerant in said tube runs flows substantially cross current to said fluid in said plate assembly fluid paths.

55. The heat exchanger of claim 45, wherein:

said refrigerant in said tube runs and said fluid in said plate assembly fluid paths are adapted to flow substantially in the same direction, either concurrent or countercurrent; and said inlet and outlet portions of said plates projecting beyond opposite lateral sides of said tube runs.

56. The heat exchanger of claim 45, further comprising spacer inserts between said inlet and outlet portions of adjacent plate assembly fluid paths, said spacer inserts including openings therethrough connecting aligned openings of said adjacent plate assembly fluid paths.

57. The heat exchanger of claim 45, wherein:

said three plate assembly fluid paths include a first set of aligned openings through said spaced plates, said first set of aligned openings being aligned with said fluid heat exchanger inlet for receiving said fluid into said three plate assembly fluid paths; and said three plate assembly fluid paths include a second set of aligned openings through said spaced plates, said second set of aligned openings being aligned with said fluid heat exchanger outlet for outleting said fluid from said three plate assembly fluid paths to said fluid heat exchanger outlet.

58. The heat exchanger of claim 45, further comprising:

a second serpentine multiport tube defining a second plurality of tube runs with a tube bend between adjacent tube runs, said second tube being generally aligned with and behind said first tube and having:

an inlet end on one tube run for receiving refrigerant from said refrigerant inlet header portion, and an outlet end on another tube run for discharging refrigerant into said refrigerant outlet header portion;

wherein said tube runs of said second tube are interleaved with said plate assembly fluid paths.

59. The heat exchanger of claim 58, further comprising:

a first header connected to said inlet end of said first serpentine multiport tube and said outlet end of said second serpentine multiport tube; and a baffle separating said connected inlet end of said first serpentine multiport tube from said connected outlet end of said second serpentine multiport tube.

60. The heat exchanger of claim 45, wherein in each of said plate assembly fluid paths, said fluid flows in substantially the same direction as said refrigerant flows in said tube positioned against said one plate of said fluid path.

61. The heat exchanger of claim 45, wherein in each of said plate assembly fluid paths, said fluid flows in substantially the opposite direction as said refrigerant flows in said tube positioned against said one plate of said fluid path.

62. The heat exchanger of claim 45, further comprising turbulating elements in said enclosed space between said fluid inlet and said fluid outlet.

63. The heat exchanger of claim 45, wherein said refrigerant is $CO_2$.

64. The heat exchanger of claim 45, wherein each of said plate assembly fluid paths includes a fluid inlet and a fluid outlet generally disposed at opposite ends of said tube run.

65. A transcritical cooling system, including the heat exchanger of claim 45.

66. The heat exchanger of claim 45, wherein said plate assembly fluid paths are drawn cup heat exchangers.

* * * * *